US005518245A

United States Patent [19]

Nelson

[11] Patent Number: 5,518,245

[45] Date of Patent: May 21, 1996

[54] GOLF PRACTICE APPARATUS

[76] Inventor: Harry Nelson, 7932 W. 79th St., Playa Del Rey, Calif. 90293

[21] Appl. No.: 520,827

[22] Filed: Aug. 29, 1995

Related U.S. Application Data

[63] Continuation of Ser. No. 373,066, Jan. 17, 1995, abandoned.

[51] Int. Cl.[6] ..... A63B 69/36

[52] U.S. Cl. ..... 473/279; 108/7

[58] Field of Search ..... 273/195 R, 195 A, 273/195 B, 187.1, 176 H, 187.2; 108/1–10; 472/6, 8, 9, 11, 16, 19, 28, 29, 35, 47, 91, 92, 130, 135

[56] References Cited

U.S. PATENT DOCUMENTS

| | | | |
|---|---|---|---|
| 3,633,917 | 1/1972 | Anderson | 273/195 A |
| 3,639,923 | 2/1972 | Stewart | 273/195 A |
| 3,693,979 | 9/1972 | Koett | 273/195 A |
| 3,869,127 | 3/1975 | Kohori | 273/195 A |
| 4,779,796 | 10/1988 | Lai | 273/195 B |
| 4,875,684 | 10/1989 | Benilan | 273/195 B |
| 5,340,111 | 8/1994 | Froelich | 273/195 B |
| 5,358,251 | 10/1994 | Ashton | 273/195 B |
| 5,460,379 | 10/1995 | Cleland | 273/195 B |

*Primary Examiner*—Sebastiano Passaniti

[57] ABSTRACT

An improved apparatus for golf practice formed from two coaxial wedge-shaped structures, one above the other and rotatable relative to each other and with respect to an underlying supporting platform to provide tilt and tilt direction for practicing golf swings on up slope, down slope and cross slope lies, to simulate the various slope and slope directions of a real golf course. The lower wedge-shaped structure acts as a solid support for the upper wedge-shaped structure and rotation of the upper wedge-shaped structure may result in the tilt of the upper surface of the upper wedge-shaped structures over a continuous range from zero degrees up to the total of the angles of the two wedge-shaped structures. The direction of the tilt angle of the upper surface of the upper wedge-shaped structure relative to an underlying planar base can then be varied by rotating the two structures together about a vertical axis. The upper surface of the upper wedge-shaped structure is preferably covered with a simulated grass mat. The wedge-shaped structures may be either solid or formed from an assembly of structural elements that are arranged into a wedge shape and may be rotated manually and locked in a selected position, or each may be driven to such selected position by a powered drive assembly disposed either internally or externally on the structure itself.

16 Claims, 5 Drawing Sheets

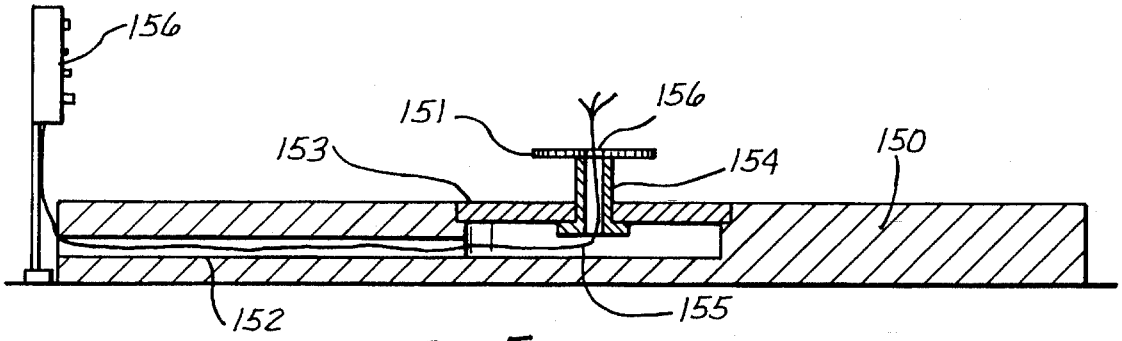
Fig. 5
Fig. 6
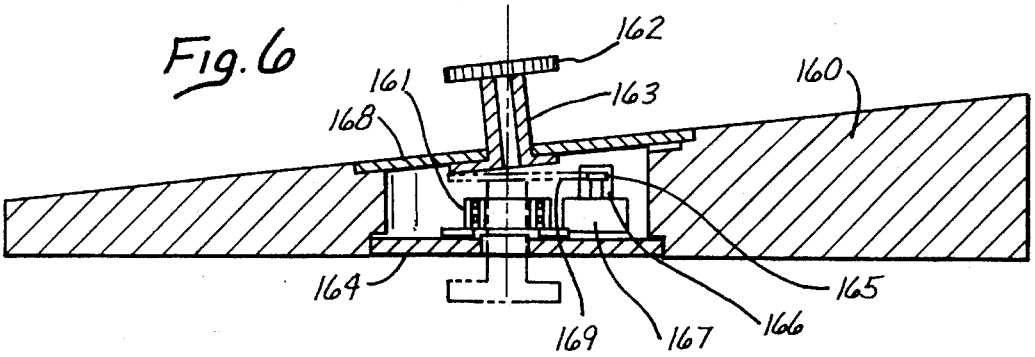
Fig. 7
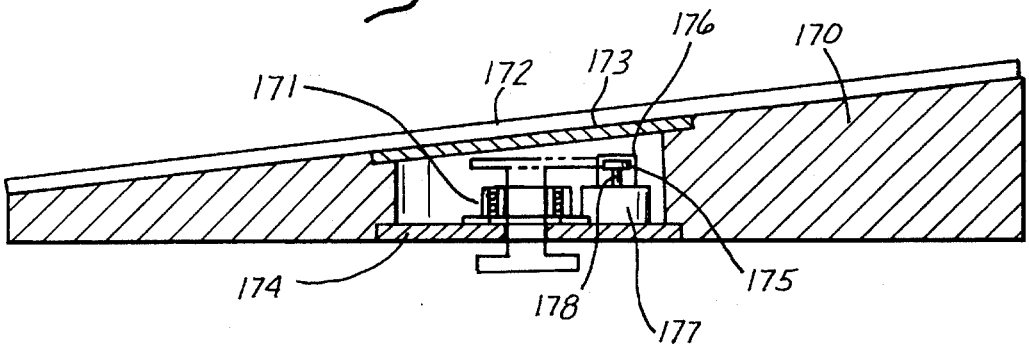

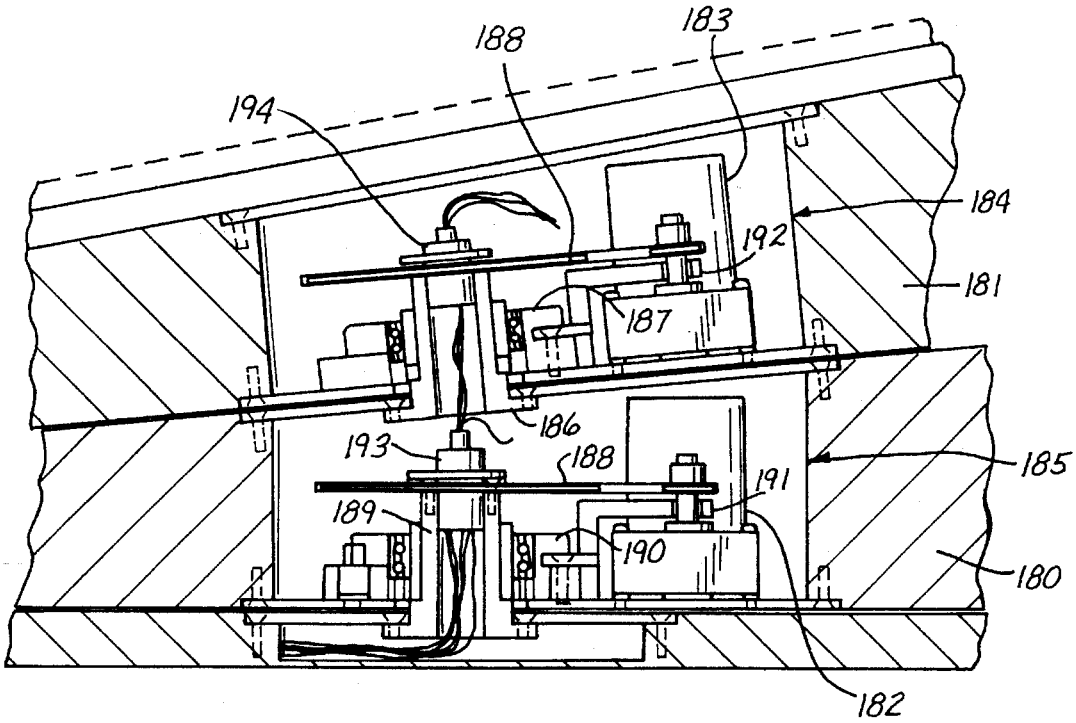
Fig. 8
Fig. 11
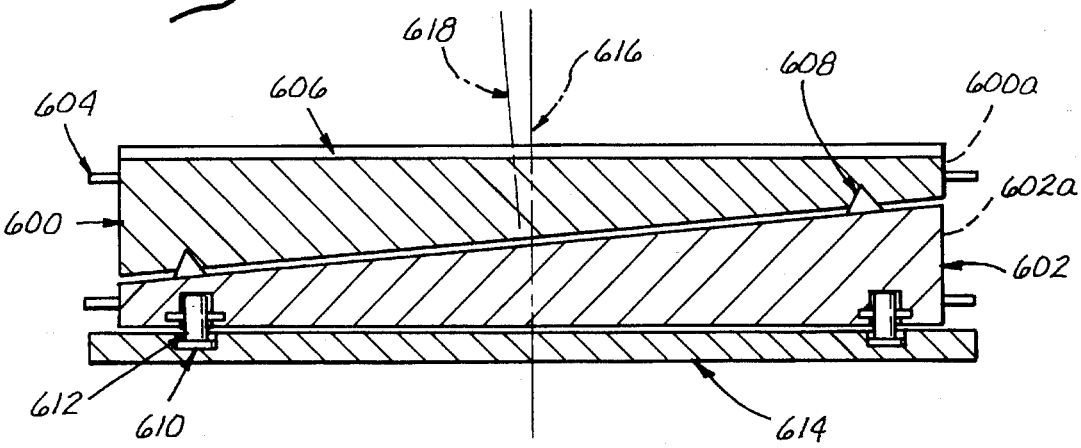

GOLF PRACTICE APPARATUS

This is a continuation of my application Ser. No. 08/373,066 filed Jan. 17, 1995, abandoned.

1. Field of the Invention

This invention relates to the sports training field, and specifically to apparatus for training golfers.

2. Background of the Invention

In training for the game of golf it is necessary that the player should be able to make golf strokes which simulate the uneven terrain of a golf course. The uneven terrain of a golf course requires the golfer to make shots uphill, down hill and on side hill lies. This invention provides a platform which, in certain embodiments, is power driven to produce the variations in tilt and tilt direction for simulating the uneven ground of a golf course for practicing strokes under a wide range of slope conditions. In other embodiments, the variations in tilt and tilt direction may be effected manually turning the basic wedge-like components.

A number of attempts to provide a platform whose planar position is changeable with respect to the ground have failed, since the previous inventions have entailed solutions of great structural and mechanical complexity requiring tilt axes, struts, linkages, and hydraulic cylinders or electrical actuators, and other methods for obtaining platform tilt, and the addition of locks on the axes to provide the required stability to withstand the forces of a person making a shot while standing on said platform.

Patents which have dealt with the problem of providing simulated uneven lies for golf practice are U.S. Pat. Nos. 2,879,996, 2,936,875, 3,393,979, 3,633,917, 3,633,918, 4,613,133, 5,005,837 and 5,133,557. Most of these patents use pivots and one or more tilt axes which are supported by struts and actuated by hydraulic cylinders or electrical driven linear actuators and other complex mechanisms, and result in a platform that is not as rigid and stable as this invention. Because these patents require complex mechanisms, they have not been brought to market. As is evident, there is still need for a stable, easily adjustable tilting platform with an absolute minimum complexity and minimum requirement for mechanisms and moving parts.

Typical of the above lists of patents is U.S. Pat. No. 3,633,918 of Smiley, which uses two triangular structures which form two horizontal pivot axes driven by hydraulic cylinders or electrical jacks which provide rotation and also provide struts to help support the tilted platform. This results in a relatively complicated tilting platform which is high off the ground and therefore flexible. Each axis must be locked to prevent the platform from tilting as the golfer standing on the platform makes a golf stroke. U.S. Pat. No. 2,937,875 issued to Mason et al. provides tilt in various directions by having disconnectable hinge points for tilt direction and is tilted by means of a hydraulic cylinder in the center of the platform. U.S. Pat. No. 3,633,917 of Anderson, uses a large spherical bearing to form a tilt axis for a platform which is then tilted by hydraulic cylinders, resulting in a tilting platform which is high off the ground and therefore less stable for the golfer standing on the platform, and which contains numerous mechanical parts for locking the platform in a stable position. U.S. Pat. No. 4,875,684 of Benilan employs a combination of moving jacks and fixed pivot points to tilt the platform, resulting in a more complex device for accomplishing tilt and tilt direction. U.S. Pat. No. 5,005,837 of Urra Martinez utilizes a hydraulic cylinder to tilt the practice platform which is then rotated about a central axis to change the direction of tilt, resulting in a flexible and therefore more unstable drive platform for golfer to stand on.

All of these prior inventions have a plethora of moving parts and mechanisms which result in high costs and therefore they are not on the market.

While the 1972 patent to Lee E. Koett, U.S. Pat. No. 3,393,979 teaches the concept of effecting changes in surface tilt by providing one or two wedge-like members independently rotatable about intersecting axes, the apparatus requires a concrete base emplacement and its powered rotation is limited to the lowermost wedge member (where more than one such wedge is provided), or to the sing wedge platform, and rotation of such member is a accomplished through gearing disposed on a permanent concrete base. This requires somewhat heavy and expensive construction and, even then, only one wedge is power-rotated. Also, once the Koett system is installed, it cannot be easily moved to another location so it must be left in position, where, if normally set up outdoors, it is subjected to the weather elements.

Because of the drawbacks of such prior art devices, they have not been readily set up, if at all.

OBJECTS AND SUMMARY OF THE INVENTION

The principal object of the invention is to provide a practice surface which can tilt to provide the golfer simulated golf lies that can range from a level surface to a surface that can tilt through angles and angular tilt direction expected on a real golf course, while at the same time providing a rigid and stable non-flexible platform for the golfer as he practices on the platform. It is also an object to avoid the disadvantages of the above referenced patents to the extent that they are made up of relatively complex mechanisms using levers and tilt axes that support the playing surface and are therefore too flexible when the golfer swings and are costly to build. It is also an object of the present invention to accomplish the platform tilt function and tilt direction with an absolute minimum of moving parts and, therefore, costs, and to provide an assembly which may be readily moved from one location to another.

The platform tilt and tilt direction can be accomplished by this invention in its simplest version with two moving members, namely, an upper wedge shaped platform assembly that, when rotated on a similar lower wedge platform assembly, provides tilt, and a lower wedge shaped platform assembly which provides direction of tilt when it is rotated in combination with the attached upper platform assembly about a vertical axis, relative to the plane of the ground. The platform can be easily tilted and the direction of tilt can be accomplished by electrical motor rotation of the wedges about an axis through the lower surface of each wedge. In one embodiment of the invention, the electrical motors and gear boxes may be contained within the configuration of each of the wedges, allowing rotation of the two wedge assemblies with no driving parts or drives extending or projecting below ground level.

In another embodiment of the invention, the powering elements may be attached at selected locations on the periphery of each wedge assembly, where they go around with the wedge assembly.

In the simplest and least expensive embodiments of the invention, each wedge assembly is provided with some means where it may be manually rotated about an axis perpendicular to the surface in which it rotates. In the case of the lower wedge assembly, it will rotate on a base platform which may be provided with a vertical cylindrical element which fits into a bearing in the lower surface of the lower wedge; or, alternatively, the platform may be provided with some type of circular track on which the lower wedge may be rotatably seated. Similarly, the upper wedge may rotate about the vertical axis of the upper surface of the lower wedge, either by an axle bearing combination, or a circular track and a rider arrangement. To facilitate rotation of the manually operated embodiment, one or more handles may be provided about the periphery of the wedge members; and, in order to prevent unwanted rotation—particularly when a golfer is standing on the upper surface of the upper wedge member, means may be provided to lock the lower wedge to its supporting platform and the upper wedge to the lower wedge.

DESCRIPTION OF THE DRAWINGS

In order to better understand the nature of the invention, the following is a detailed description of the invention using various detailed figures.

FIG. 5 shows the base assembly for mounting the wedge assemblies.

FIG. 6 shows the lower wedge assembly and its internal drive.

FIG. 7 shows the upper wedge assembly and its internal drive.

FIG. 8 is an embodiment of the invention that utilizes slip rings on each of the rotating axles to provide power and continuous rotation of the wedge assemblies.

FIG. 9*a* is a plan view of the embodiment shown in FIG. 9.

FIG. 9*b* is an enlarged detail in perspective of locking means shown in FIGS. 9 and 9*a*.

FIG. 11 is a side elevation of an unpowered embodiment of the invention in which relative rotation of the wedges about their axes is accomplished by rollers or other elements and track means.

DESCRIPTION OF THE PREFERRED EMBODIMENTS

Figure 1:
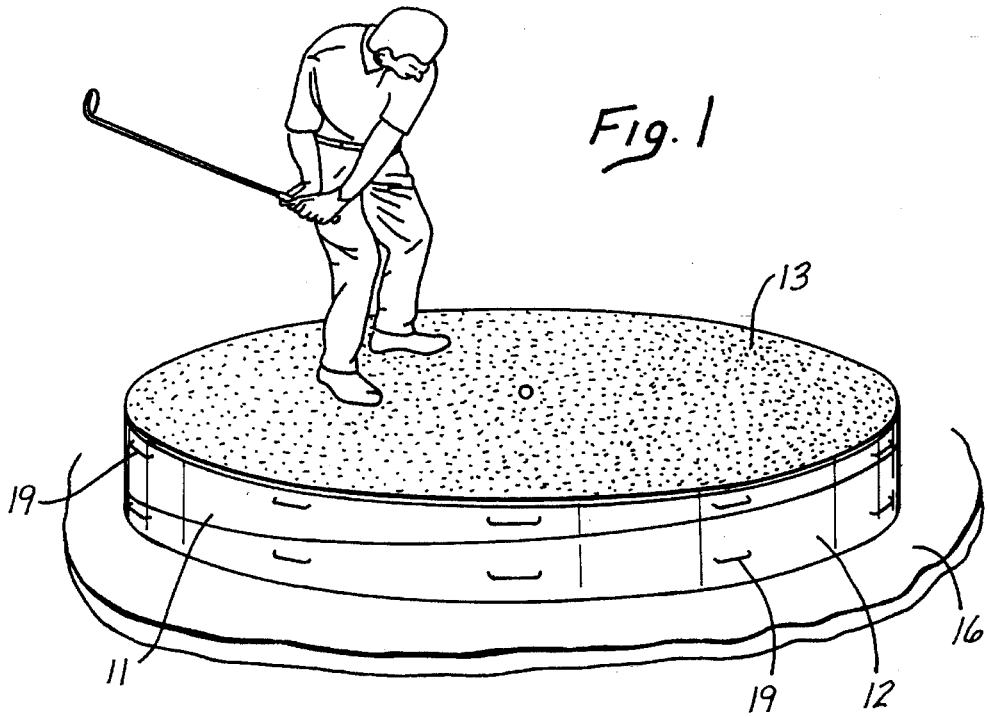
FIG. 1 shows a three dimensional artist sketch of a version of this invention with only two moving parts.

As shown in FIG. 1, the invention consists of a platform 13 on which the golfer stands to practice his stroke, supported by an upper wedge 11 which, when rotated about its axis relative to a bottom wedge 12, tilts the platform. When both wedges 11, 12 are rotated together, the result is a change in direction of the tilted platform 13.

Figure 2:
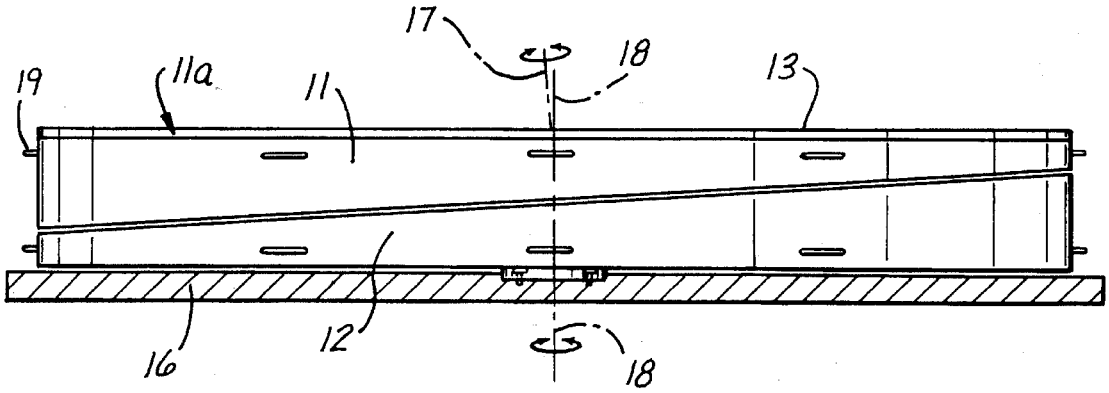
FIG. 2 shows a side elevation view of the embodiment of FIG. 1 comprising a base on which are mounted two wedge shaped structures which rotate relative to each other for tilt and which rotate together to provide tilt direction.

As shown in FIG. 2, the simplest version of the invention can be made up of two wedge shaped members or assemblies 11, 12 and a base platform 16. Wedge-shaped member 11 is placed on top of wedge-shaped member 12 and is provided with a rotational axis 17 which provides tilt of the upper surface 11*a*. The upper surface of wedge 11 tilts as the wedge is rotated about its axis 17 up to two times the wedge angle with 180 degrees of rotation about said axis 17. The tilt direction can then be changed to any point of the compass by rotating the combination of wedge 11 and wedge 12 about a vertical axis 18, relative to the plane of the ground on which base platform 16 is disposed.

Figure 3:
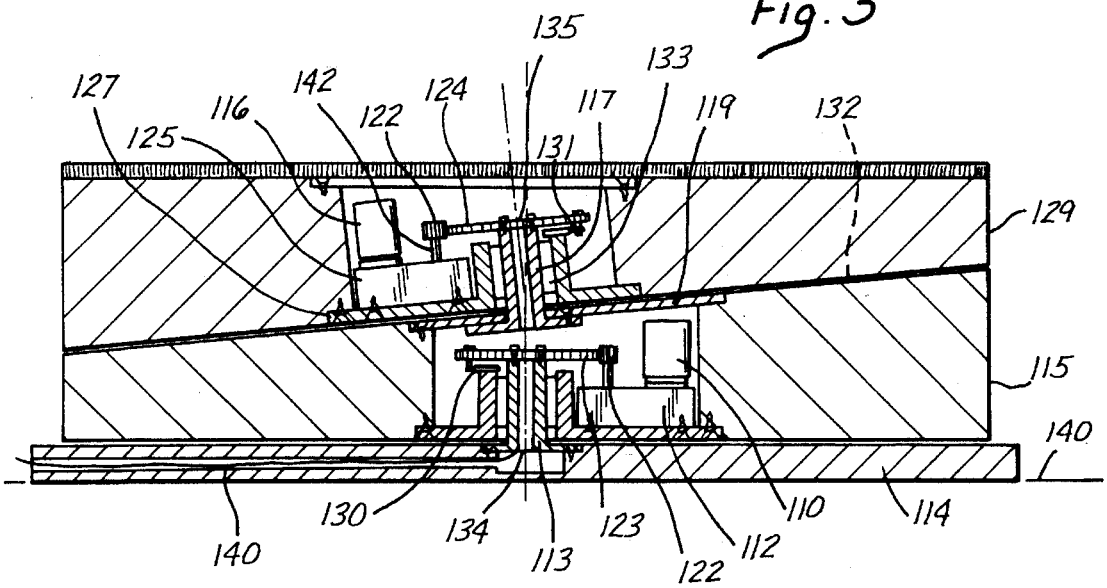
FIG. 3 shows a cross section of the first embodiment of the invention which is comprised of two solid wedge assemblies with rotational axes for tilt and tilt direction driven by motor gear boxes contained totally within each wedge configuration.

The embodiment of the invention as shown in FIG. 3 contains the drive motor 110 and its gear box 112 that drives the lower wedge assembly 115 and all of the elements of the upper wedge assembly 129 around a stationary central shaft 113. The shaft 113 is attached to a stationary base plate 114 to provide the lower wedge assembly 115 a central pivot anchor against which to torque. The elements of the upper wedge assembly 129 and its drive assembly 116 and 125 and the drive mounting plate 127 may be identical to corresponding elements of the lower wedge assembly 115 and its driving elements 110, 112. Thus, the motor 116 and its gear box 125 are arranged so that they drive themselves and all of the upper wedge assembly 129 about a stationary shaft 117 that is attached to a plate 119 mounted on the top-tilted surface 132 of the lower wedge 115. The-drive motor 116 and gear box 125 are rigidly attached to the outer race of the central bearing assembly 133 by mounting plate 127. The central bearing assembly 133 has its inner bearing race attached to the stationary shaft 117. Each stationary shaft 113, 117 has a center hole 134, 135, respectively, for routing the electrical wires 140 through the hollow center 134 of shafts 113, 117 to supply drive power to the electric motors 110, 116 and, in turn, allowing rotation of the upper wedge 129 in a continuous fashion to provide tilting of the upper platform and rotation of the tilt direction to any target angle relative to a horizontal ground plane 140 by rotation of the upper and lower wedges 115, 129 as a single assembly about the shaft 113 attached to a base plate 114. Electrical switches 130, 131, limit the rotation of the wedges 115, 129 to plus or minus 180 degrees to, in turn, limit the wind up of the electrical wires 140. Drive torque which rotates the wedges 115, 129 about the stationary central shafts 113 and 117 is provided by the output shaft sprocket or gear 122, 124 of the gear boxes 112, 125, respectively. The drive may be either a roller chain or be a spur gear mounted on the output shaft 142, 143 of the gear box driving a spur gear or sprocket 124, 123 mounted on the stationary central shafts 113 and 117.

Figure 4:
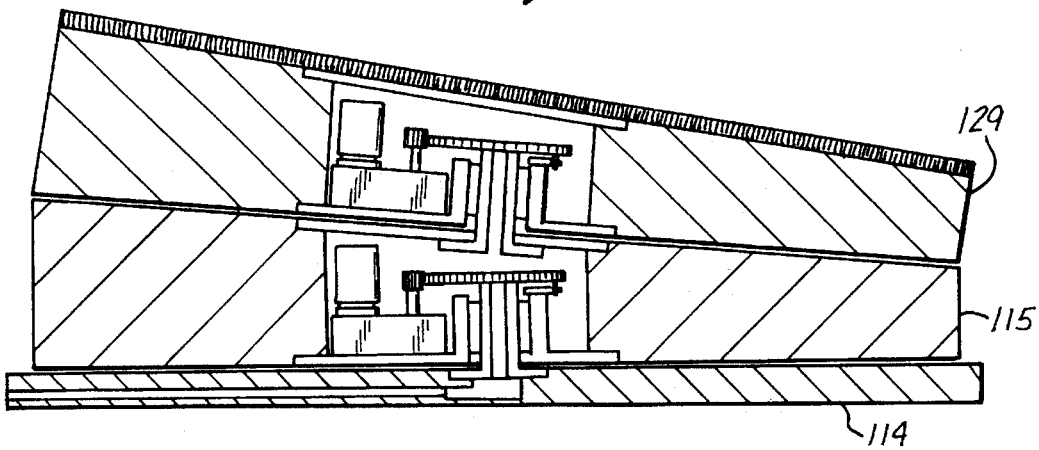
FIG. 4 shows the invention with the upper wedge assembly rotated 180 degrees relative to the lower wedge to obtain tilt, and the lower wedge assembly rotated 180 degrees to obtain tilt direction.

FIG. 4 shows the upper wedge assembly 129 rotated 180 degrees relative to the lower wedge assembly 115 thereby causing the upper surface of the practice platform to tilt to an angle that is the sum of the two wedge angles. Also, the lower wedge assembly 115 is shown rotated 120 degrees relative to the base 114 to demonstrate rotation of the direction of the tilt angle relative to an azimuth direction.

By designing the drive assemblies in this embodiment to rotate with the wedges no projection out of the wedge volume results.

The apparatus may comprise three subassemblies, namely that of FIG. 5, the base assembly A, that of FIG. 6, the lower wedge assembly B, and that of FIG. 7, the upper wedge assembly C.

In FIG. 5, the base assembly A comprises a base structure 150 which contains a channel passageway 152 for routing the electric drive wires 155 through a central hole 156 in the stationary shaft 154. The latter is mounted on a plate 153 secured to the base structure 150.

In FIG. 6, chain sprocket or gear 162 is shown, but is attached to the stationary shaft 154 of FIG. 5 after the lower wedge assembly B is lowered over the stationary shaft 154 on the base 150. An electrical control box 156 for the drives provides control means.

With further reference to FIG. 6, the lower wedge assembly B contains the full drive assembly 165, 166, 167 within the wedge volume and consists of a wedge 160 which mounts on top of the base assembly A of FIG. 5. It comprises a base plate 164 attached to the bottom of the wedge 160 that provides the mounting for a pillow block type bearing assembly 161 and a mounting for the gear box 167 which contains a drive motor 166 and a sprocket 165 that is coupled by use of a roller chain 169 to the sprocket of the base assembly 151 in FIG. 5. The lower wedge assembly B has a plate 168 that attaches to the top of the lower wedge 160 and supports the stationary shaft 163 and sprocket 162 that form an axle for the mounting and drive for the upper wedge assembly C. The sprocket 162 is attached to the stationary shaft after the pillow block 171 of the upper wedge assembly C of FIG. 7 is lowered over the shaft 163.

The upper wedge assembly C shown in FIG. 7 comprises the wedge body 170, a mounting plate 174 which provides the mounting for a central pillow block 171 and a drive assembly consisting of a gear box 177, a drive motor 176 and a sprocket 175 attached to the output shaft 178 of the gear box 177. Said drive components are completely within the wedge volume. The drive assembly rotates the upper wedge assembly C about the stationary sprocket 162 on the lower wedge assembly B of FIG. 6. The top of the wedge 170 is provided with a plate 173 which covers the central cavity of the upper wedge 170. A simulated grass mat 172 or real growing grass 172 or a tray containing sand 172 is disposed over the top of the wedge 170 and plate 173 to provide the practice surface for the golfer.

A second embodiment of the invention shown in FIG. 8 is provided with electrical slip rings to allow continuous rotation of the wedges. FIG. 8 shows a cross section through the base structure 182, and the lower wedge assembly 180 and the upper wedge assembly 181. The drive assemblies 182, 183, for the wedges 180, 181, respectively, are contained within cavities 184, 185 in the centers of the wedges 180, 181, respectively, allowing the drives to be completely within the wedge volume. The two wedge assemblies 180, 181 can be made identical except that the lower wedge assembly 180 has a shaft 186 that projects up into the bearing 187 of the upper wedge 181 to constitute a stationary shaft about which the upper drive assembly 183 rotates. A roller chain or gear 188 is coupled to the drive sprockets or gears on the drive assemblies 182, 183, respectively, to provide rotation torque coupling for the wedges 180, 181. The base structure 182 has a shaft 189 that projects up into the bearing 190 of the lower wedge assembly 180 to provide a stationary shaft about which the lower drive 182 assembly rotates. Brackets 191, 192 provide structures that supply additional moment load paths between the drive assemblies 182, 183, and the stationary shafts to reduce the bending load on the shafts projecting from the drive assemblies. The electrical slip ring 193 provides the electrical connection between the stationary base assembly 182 and allows continuous rotation of the lower wedge assembly 180 about the base mounted stationary shaft 189. The electrical slip ring assembly 194 provides the electrical connection between the lower wedge assembly 180 and the upper wedge assembly 181 to provide power to the upper wedge drive 183 and to allow continuous rotation of the upper wedge 181.

Figure 9:
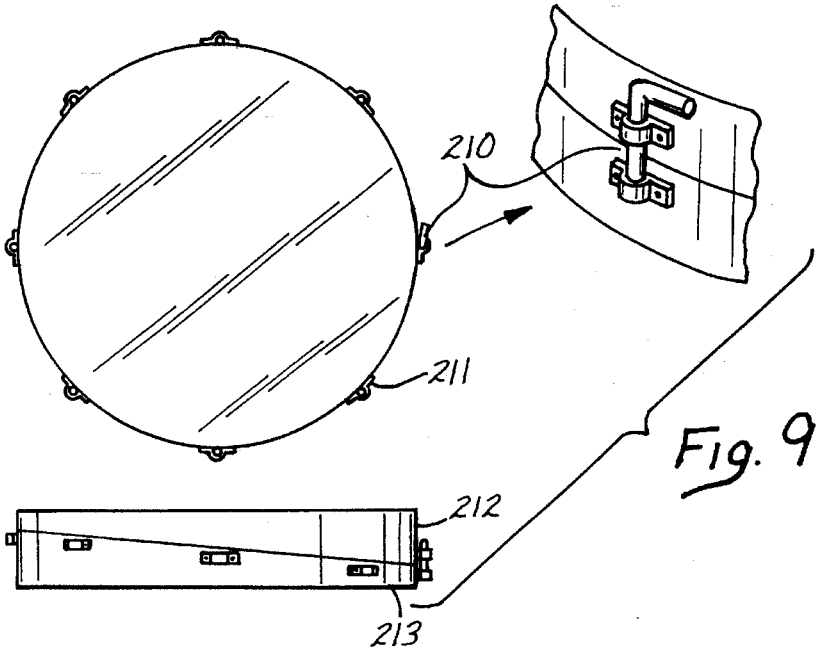
FIG. 9 is a side elevation (reduced in size) of an embodiment of the invention in which a series of locking means are provided about peripheries of the wedge members.

A third embodiment of the invention FIG. 9 uses an external lock on the periphery of the wedges consisting of a lock bolt assembly 210 attached to the upper wedge assembly 212 and receptacles 211 for the locking bolt 210 located at various places around the periphery of the lower wedge assembly 213.

Figure 10:
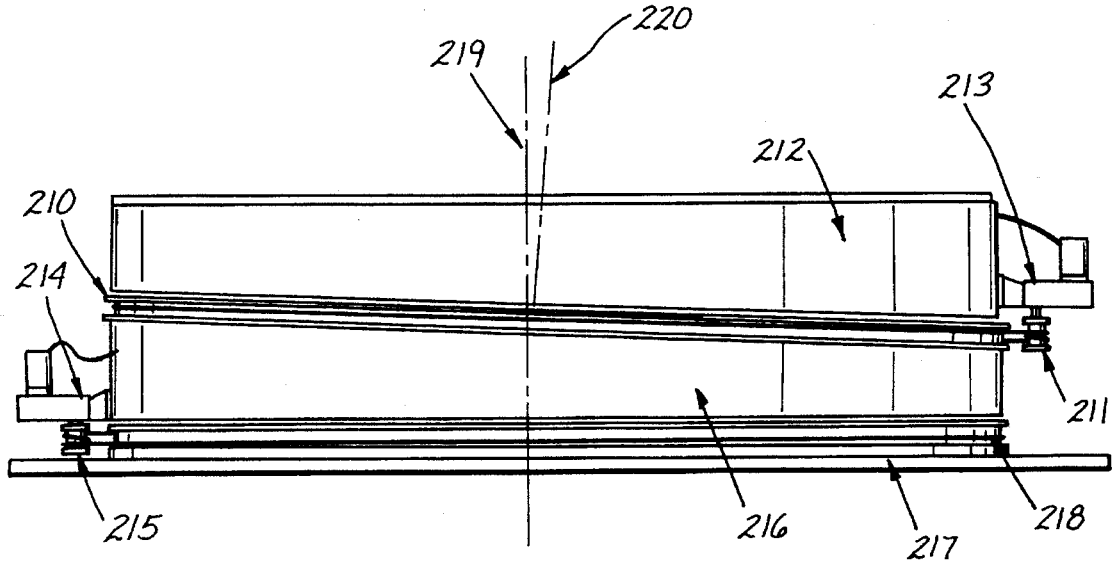
FIG. 10 is a side elevation showing an external drive embodiment of the invention where the drive assemblies rotate with the wedges.

A fourth embodiment of the invention as shown in FIG. 10 mounts the drives externally to the wedge volume but the drives rotate with the wedges allowing the complete golf practice platform to be placed as a unit on the ground surface. As shown, the upper wedge 212 is rotated about the axis 220 perpendicular to the upper surface of the lower wedge 216 by the externally mounted drive assembly 213 which may have a capstan 211 or gear or roller chain output sprocket which drives against the drum 210 mounted on the lower wedge 216. The drive may be a capstan or roller chain or gear type drive. The drive assembly 213 rotates with the upper wedge 212. The lower wedge 216 along with the complete upper wedge assembly is rotated about the vertical axis 219 by the externally mounted lower wedge drive assembly 214 which may have a capstan drive 215 driving the drum 218 attached to the base 217. The drive may be the capstan type 215 shown or may be a gear drive or a roller chain type drive (not shown here). Electrical power to the rotating drives 213; 214 may be routed through the center of the wedges as described in the FIG. 5 and 8 embodiments.

Alternatively, since each wedge may rotate only 180 degrees, a power cord may be connected between an external power plug and each drives 213, 214 in an obvious manner not shown.

A further embodiment of the invention which is shown in FIG. 11, uses track type rotational guides. Here, the base 614 has a circular track surface 610 which guides the rollers 612 mounted at several places in a circular path on the under side 603 of lower wedge 602, thereby to allow the lower wedge 602 to be rotated about the vertical axis 616 to provide tilt direction. The same track and roller system could be used for the top wedge 600. However, as shown in FIG. 11, the top wedge contains a circular track grove 609 which guides a projecting ring 608 that fits into the grove 609 to rotate the top wedge 600 about the tilted axis 618 to provide platform tilt. The wedges 600, 602 may be manually rotated by gripping handles 604 around the peripheries **600*a*, 602*a* of the wedges, 600, 602**, respectively.

When the wedge 602 is manually rotatable with respect to the base 614, and the wedge 600 so rotatable in relation to the wedge 603, means, such as locks 620 or pins 622 should be provided to prevent undesired rotations—particularly when a golfer is standing on the top of the upper wedge 600 in the manner shown in FIG. 1.

It should be apparent to one skilled in the art from what is thus shown and explained with reference to FIG. 11 that other means may be substituted to enable the two wedges 600, 602 to be mounted and manually rotated about the respective axes 616, 618, respectively.

I claim:

1. Golf training apparatus, said apparatus comprising:

A. a supporting platform adapted to lay flat upon a ground floor or other horizontal surface, said platform being of a predetermined configuration disposed about a central vertical axis, and having a planar upper surface;

B. a first wedge-shaped circular member disposed rotatably on the planar upper surface of the platform; said member having a planar horizontal bottom surface, the axis of which coincides with the axis of the platform, and a planar upper surface, the plane of said upper surface of said first wedge-shaped circular member intersecting the plane of the bottom surface at a first predetermined angle;

C. means interposed between the upper surface of said platform and the bottom surface of the first wedge-shaped circular member, whereby the first wedge-shaped circular member may be rotated about the axis of the platform;

D. a second wedge-shaped member disposed rotatably on the upper surface of the first wedge-shaped circular member, said second member having a planar bottom surface, the plane of which is parallel to the plane of the upper surface of the first wedge-shaped circular member, with the axis of said bottom surface of the second wedge-shaped member intersecting the axis of the platform and the bottom of the first wedge-shaped circular member in the plane of the upper planar surface of the first wedge-shaped circular member, said second wedge-shaped member having a planar upper surface, the plane of said upper surface of said second wedge-shaped member intersecting the plane of the bottom surface of the second wedge-shaped member at a second predetermined angle;

E. first powered means to effect rotation of said first wedge-shaped circular member to, and to secure it in, a selected angular position relative to the platform; said first powered means being carried by the first wedge-shaped circular member;

F. second powered means to effect rotation of the second wedge-shaped member to, and to secure it in, a selected angular position relative to the upper planar surface of the first wedge-shaped circular member, said second powered means being carried by the second wedge-shaped member; and G. control means accessible externally of the second wedge-shaped member, said control means serving to operate said second powered means to dispose the second wedge-shaped means in selected angular positions relative to the first wedge-shaped circular member;

whereby the upper surface of the second wedge-shaped member may be moved between a first position with the upper planar surface parallel to the upper surface of the platform, and a second position disposed at the second predetermined angle relative to the platform.

2. The apparatus as described in claim 1 wherein the disposition of the first wedge-shaped circular member rotatably on the planar upper surface of the platform is accomplished by providing an axle projecting upwardly from, and normal to, the upper surface of the platform, and further providing a bearing receptacle for said upwardly projecting axle, in the bottom surface of the first wedge-shaped circular member.

3. The apparatus as described in claim 1 wherein an annular plastic element is interposed between the planar bottom surface of the second wedge-shaped member and the planar upper surface of the first wedge-shaped circular member, the annular element being coaxial with the surfaces between which it is interposed.

4. The apparatus as described in claim 1 wherein a solid annular bearing spacer element is interposed between the planar bottom surface of the second wedge-shaped member and the planar upper surface of the first wedge-shaped circular member, said annular bearing spacer element being coaxial with the surfaces between which it is interposed.

5. The apparatus as described in claim 1 wherein the first wedge-shaped member is formed as a solid body.

6. The apparatus as described in claim 1 wherein the first wedge-shaped circular member and the second wedge-shaped member are formed of metallic frames and disks.

7. The apparatus as described in claim 1 wherein rotation of at least one of the first wedge-shaped circular member and the second wedge-shaped membe; is accomplished by providing electrical or hydraulic power means.

8. The apparatus as described in claim 7 wherein the electrical or hydraulic power means are connected to a control panel removed from the apparatus.

9. The apparatus as described in claim 7 wherein the electrical or hydraulic power means are connected to a control panel attached to the apparatus.

10. The apparatus as described in claim 1 wherein means are provided for locking the rotatable first wedge-shaped circular member and the second wedge-shaped member in preselected angular positions.

11. The apparatus as described in claim 1 wherein the first means to effect rotation of the first wedge-shaped member comprises an electric drive motor carried by said first wedge-shaped circular member.

12. Golf training apparatus, said apparatus comprising:

A. a supporting platform adapted to lay flat upon a ground floor or other horizontal surface, said platform being of a predetermined configuration disposed about a central vertical axis, and having a planar upper surface;

B. a first wedge-shaped circular member disposed rotatably on the planar upper surface of the platform; said member having a planar horizontal bottom surface, the axis of which coincides with the axis of the platform, and a planar upper surface, the plane of said upper surface of said first wedge-shaped circular member intersecting the plane of the bottom surface at a first predetermined angle;

C. means interposed between the upper surface of said platform and the bottom surface of the first wedge-shaped circular member, whereby the first wedge-shaped circular member may be rotated about the axis of the platform;

D. a second wedge-shaped member disposed rotatably on the upper surface of the first wedge-shaped circular member, said second member having a planar bottom surface, the plane of which is parallel to the plane of the upper surface of the first wedge-shaped circular member and intersecting the axis of the platform and the bottom of the first wedge-shaped circular member in the plane of the upper planar surface of the first wedge-shaped circular member, said second wedge-shaped member having a planar upper surface, the plane of said upper surface of said second wedge-shaped member intersecting the plane of the bottom surface of the second wedge-shaped member at a second predetermined angle and said second wedge-shaped member being at least partly hollow to define a cavity about the axis of its planar bottom surface;

E. first means to effect rotation of said first wedge-shaped circular member to, and to secure it in, a selected angular position relative to the platform;

F. second powered means to effect rotation of the second wedge-shaped member to, and to secure it in, a selected angular position relative to the upper surface of the first wedge-shaped circular member, said second powered means being disposed within the cavity of the second wedge-shaped member; and G. control means disposed laterally beyond the periphery of the first wedge-shaped circular member, said control means serving to operate said second powered means to dispose the second wedge-shaped means in any selected angular position relative to the first wedge-shaped circular member, whereby the upper surface of the second wedge-shaped member may be moved between a first position with the upper planar surface parallel to the upper surface of the platform, and a second position disposed at an angle relative to the platform.

13. Golf training apparatus, said apparatus comprising:

A. a supporting platform adapted to lay flat upon a ground floor or other horizontal surface, said platform being of a predetermined configuration disposed about a central vertical axis, and having a planar upper surface;

B. a first wedge-shaped circular member disposed rotatably on the planar upper surface of the platform; said member having a planar horizontal bottom surface, the axis of which coincides with the axis of the platform, and a planar upper surface, the plane of said upper surface of said first wedge-shaped circular member intersecting the plane of the bottom surface at a first predetermined angle;

C. means interposed between the upper surface of said platform and the bottom surface of the first wedge-shaped circular member, whereby the first wedge-shaped circular member may be rotated about the axis of the platform;

D. a second wedge-shaped member disposed rotatably on the upper surface of the first wedge-shaped circular member, said second member having a planar bottom surface, the plane of which is parallel to the plane of the upper surface of the first wedge-shaped member, with the axis of said bottom surface of the second of wedge-shaped member intersecting the axis of the platform and the bottom the first wedge-shaped circular member in the plane of the upper planar surface of the first wedge-shaped circular member, said second wedge-shaped member having a planar upper surface, the plane of which upper surface intersects the plane of the bottom surface of the second wedge-shaped member at a second predetermined angle;

E. the planar upper surface of the first wedge-shaped circular member being provided with track means adjacent its periphery and extending about its circumference;

F. the bottom side of the second wedge-shaped member being provided with means fitting in, and to slidably travel in, said track means about the periphery of the first wedge-shaped circular member for at least 180 degrees;

G. means to lock the first wedge-shaped circular member to the platform in any of a plurality of preselected angular relationships over an arc of 180 degrees;

H. means to lock the second wedge-shaped member to the first wedge-shaped circular member in any of a plurality of preselected angular relationships over an arc of 180 degrees.

14. The apparatus as described in claim 12 wherein handle means are provided to extend from the periphery of at least one of the first wedge-shaped circular member and second wedge-shaped member to enable each said member, when unlocked, more easily to be manually rotated about the track means on which said means slidably to travel in the track means is disposed, to a preselected lockable position.

15. Golf training apparatus, said apparatus comprising:

A. a supporting platform adapted to lay flat upon a ground floor or other horizontal surface, said platform being of a predetermined configuration disposed about a central vertical axis, and having a planar upper surface; said platform further having a centrally disposed plate and a cylindrical element projecting vertically upward from and supported by said plate in said axis;

B. a first wedge-shaped circular member disposed rotatably on the planar upper surface of the platform; said member having a planar horizontal bottom surface, the axis of which coincides with the axis of the platform, and a planar upper surface, the plane of said upper surface of said first wedge-shaped circular member intersecting the plane of the bottom surface at a first predetermined angle; said member further being recessed about said axis and having a bearing adapted rotatably to receive said plate-supported element, whereby the first wedge-shaped circular member may be rotated about the axis of the platform, the upper surface of the first wedge-shaped member being provided with a centrally disposed and supported upwardly projecting cylindrical element extending in the axis of the upper surface circular;

C. a second wedge-shaped member disposed rotatably on the upper surface of the first wedge-shaped circular member, said second member having a planar bottom surface, the plane of which is parallel to the plane of the upper surface of the first wedge-shaped circular member, with the axis of said bottom surface of the second wedge-shaped member intersecting the axis of the platform and the bottom of the first wedge-shaped circular member in the plane of the upper planar surface of the first wedge-shaped circular member, said second wedge-shaped circular member having a planar upper surface, the plane of said upper surface of said second wedge-shaped member intersecting the plane of the bottom surface of the second wedge-shaped circular member at a second predetermined angle; and the bottom surface of said second wedge-shaped member being centrally received about the axis and provided with annular bearing means adapted rotatably to receive the cylindrical element projecting upwardly from the upper surface of the first wedge-shaped circular member; whereby the second wedge-shaped member member may be rotated about the axis of the upper surface of the first wedge-shaped circular member;

D. means to lock the first wedge-shaped circular member to the platform at any of a plurality of preselected angular relationships over an arc of 180 degrees; and E. means to lock the second wedge-shaped circular member to the first wedge-shaped circular member in any of a plurality of preselected angular relationships over an arc of 180 degrees.

16. The apparatus as described in claim 15 wherein handle means are provided to extend from the periphery of at least one of the first wedge-shaped circular member and second wedge-shaped member to enable each said member, when unlocked, more easily to be manually rotated about the track means on which its means slidably to travel in the track means is disposed, to a preselected lockable position.

* * * * *